US005316036A

United States Patent [19]

Berfield

[11] Patent Number: 5,316,036

[45] Date of Patent: May 31, 1994

[54] RETAINER PLATE ASSEMBLY FOR PUMP HOUSING

[75] Inventor: Robert C. Berfield, Jersey Shore, Pa.

[73] Assignee: Shop Vac Corporation, Williamsport, Pa.

[21] Appl. No.: 46,214

[22] Filed: Apr. 9, 1993

[51] Int. Cl.[5] ..... F16K 15/06; F04B 21/02

[52] U.S. Cl. ..... 137/315; 137/542; 417/454

[58] Field of Search ..... 137/315, 454.4, 512, 137/542; 417/454, 571

[56] References Cited

U.S. PATENT DOCUMENTS

| | | | |
|---|---|---|---|
| 2,367,893 | 1/1945 | Sheen | 417/454 |
| 4,716,924 | 1/1988 | Pacht | 417/454 |
| 4,758,135 | 7/1988 | Woodward | 417/454 X |
| 4,936,753 | 6/1990 | Kozumplik | 417/454 X |
| 5,067,654 | 11/1991 | Paige | 239/124 |
| 5,086,975 | 2/1992 | Paige | 239/124 |
| 5,102,312 | 4/1992 | Harvey | 417/571 |
| 5,230,471 | 7/1993 | Berfield | 239/124 |

*Primary Examiner*—Robert G. Nilson
*Attorney, Agent, or Firm*—Marshall, O'Toole, Gerstein, Murray & Borun

[57] ABSTRACT

A retainer plate assembly for securing valves of a pressure washer pump within a pump housing comprises a contoured plate and cooperating hook bolts. The contoured plate is adapted to follow the contour of the pump housing and to fit securely against the portions of the pump housing holding the valves.

13 Claims, 4 Drawing Sheets

RETAINER PLATE ASSEMBLY FOR PUMP HOUSING

TECHNICAL FIELD

The present invention relates to pressure washers, and more particularly to a plate assembly for retaining input pump housing.

BACKGROUND ART

Various pressure washers are known for pumping fluid, particularly water, at a high pressure. Such pressure washers use various pump arrangements for delivering the water, and typically another fluid, such as detergent, from an external source to a spray nozzle. Some known pressure washers such as those described in Paige, U.S. Pat. No. 5,067,654 and Paige, U.S. Pat. No. 5,086,975, both assigned to the assignee of the instant application, include a pump housing having an inlet conduit for the delivery of fluid drawn from a source, an outlet conduit for delivery of fluid to a dispensing spray nozzle and at least one, and more particularly a plurality of pumping chambers connected in parallel across the inlet and outlet conduits. The spray nozzle from the outlet conduit has a valve which is selectively opened for permitting the outflow of pumped fluid or closed for blocking fluid outflow. Such a pressure washer includes means for recirculating the flow of fluid through the pump when the spray nozzle valve is closed.

Each of the pumping chambers includes a pumping piston which reciprocates within the chamber. Input check valves are located in input conduits disposed between the inlet conduit of the pump and each pumping chamber and are normally biased in a closed position. Each input check valve is opened as the pressure in a respective pumping chamber is reduced, thereby permitting fluid to enter the pumping chamber from the inlet conduit. Output check valves are located in output conduits between each pumping chamber and the outlet conduit of the pump and are also normally biased in a closed position. Each output check valve is opened when the pressure in a respective pumping chamber increases, thereby expelling fluid from the pumping chamber through the output conduit and into the outlet conduit of the pump.

The input and output check valves are mounted in valve guides each having an outer cylindrical surface adapted to be tightly received within valve guide bores disposed in the pump housing. During operation, considerable stress is placed upon the input and output valves and valve guides as the pistons reciprocate within the pumping chambers. As a result, a frictional fit between the valve guides and the guide bores is often not sufficient to securely retain the valves within the pump housing. In the past, the valve guides were secured within the guide bores by ultrasonically welding a cap or plug located outside of the guides to the pump housing. Although ultrasonic welding usually provides an adequate attachment means between the valve guides and the pump housing, it is somewhat unreliable. Also, ultrasonic welding of each individual valve guide to the pump housing is a time consuming process.

SUMMARY OF THE INVENTION

In accordance with one aspect of the present invention, a plate assembly is utilized with a pump of a pressure washer. The pump includes a pump housing with input and output valves disposed therein. The retainer plate assembly is attached to the pump housing and is adapted to retain both the input and output valves within the housing. Preferably, the plate assembly substantially conforms to an outer contour of the pump housing.

In accordance with a specific aspect of the present invention, the plate assembly is also adapted to retain a plug within an outlet conduit of the pump housing.

Also in accordance with a specific aspect of the present invention, the plate assembly comprises a plate and means for attaching the plate to the pump housing. The attaching means is fixed to the plate and also partially surrounds first and second body portions of the housing which enclose inlet and outlet conduits, respectively.

Preferably, the attaching means comprises at least one hook bolt having a shank attached to the plate and a hook portion partially encircling either the first or the second body portion.

In accordance with another aspect of the present invention, a plate assembly for securing at least one check valve mounted on a valve guide within a pump housing comprises a contoured plate abutting against the valve guide and the pump housing and means for attaching the plate to the housing. The attaching means is connected to the plate and partially encircles first and second cylindrical portions of the pump housing.

In accordance with yet another aspect of the present invention, a plate assembly for securing a plurality of input and output check valves and at least one plug within a pump housing comprises first, second and third plate sections and means for attaching these sections to the pump housing. The attaching means is fixed to the first plate section and partially encircles first and second cylindrical portions of the pump housing. The first and second cylindrical portions enclose inlet and outlet conduits, respectively, and the plug is disposed in the outlet conduit. The pump housing also includes pumping chambers, input valves disposed between the inlet conduit and each of the pumping chambers and output valves disposed between each pumping chamber and the outlet conduit. The pump housing includes bores which receive input and output valve guides which hold the input and output valves respectively. The first and second plate sections are attached and abut against the input and output valve guides, respectively. The third plate section is attached to the first plate section and abuts against the plug.

DESCRIPTION OF THE PREFERRED EMBODIMENTS

Figure 6:
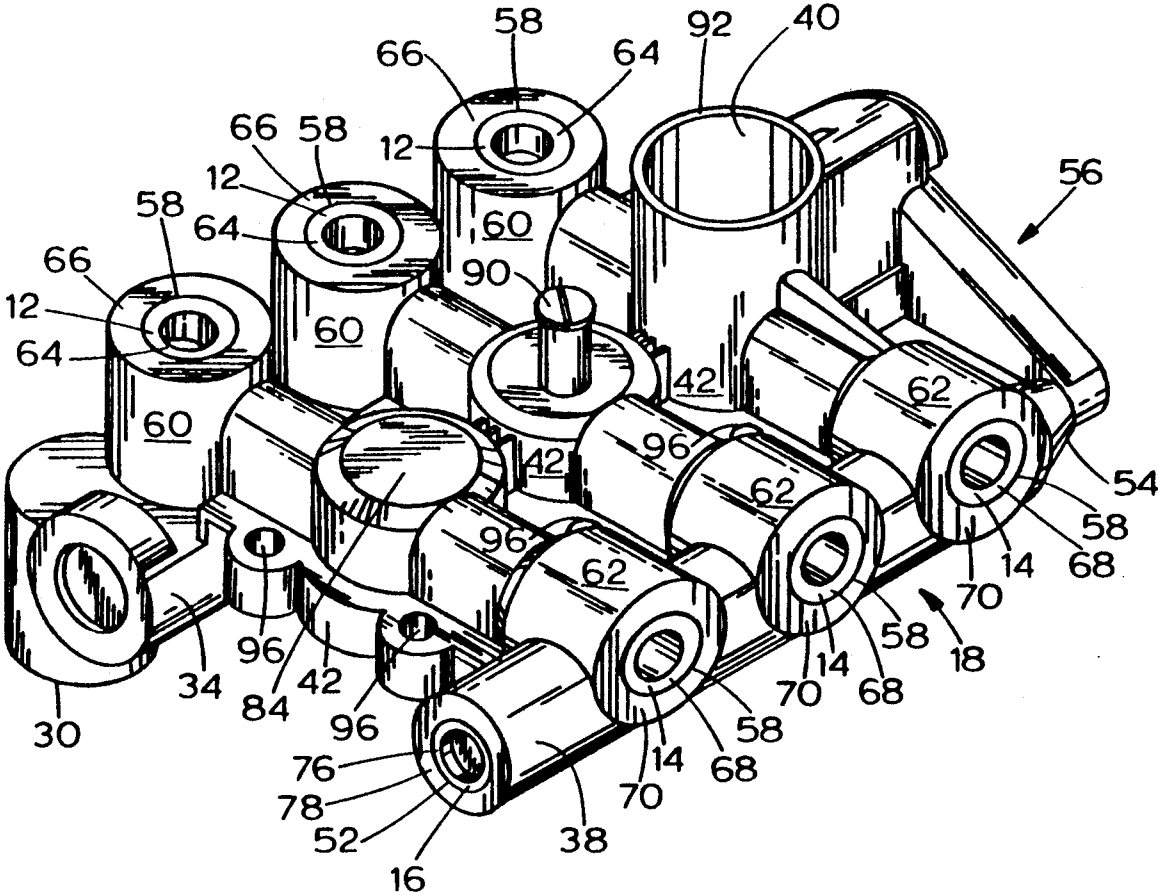
FIG. 6 comprises an isometric view of the pump housing shown in FIG. 1 detached from the retainer plate assembly.

Referring to the Figures, a plate assembly 10 according to the present invention is provided for retaining input valve guides 12, output valve guides 14 and an outlet conduit plug 16 within a pump housing 18 (all seen in FIG. 6). The plate assembly 10 includes retaining means in the form of a primary retainer plate section 20 and side plate sections 22 and 24 and means for attaching the plate sections 20, 22 and 24 to the pump housing 18 in the form of hook bolts 26 which extend through the plate section 20 and contact the pump housing 18 and in the form of a support plate section 28.

The pump housing 18 includes an inlet 30 connected to an inlet conduit 32 disposed in a substantially cylindrical housing portion 34 for the delivery of fluid drawn from a fluid source (not shown), an outlet conduit 36 disposed in a further substantially cylindrical housing portion 38 for delivery of fluid to an outlet 40 which is connected to a dispensing spray nozzle (not shown), and a plurality of substantially cylindrical pumping chambers 42 connected in parallel across the inlet and outlet conduits 32 and 36, respectively.

Figure 4:
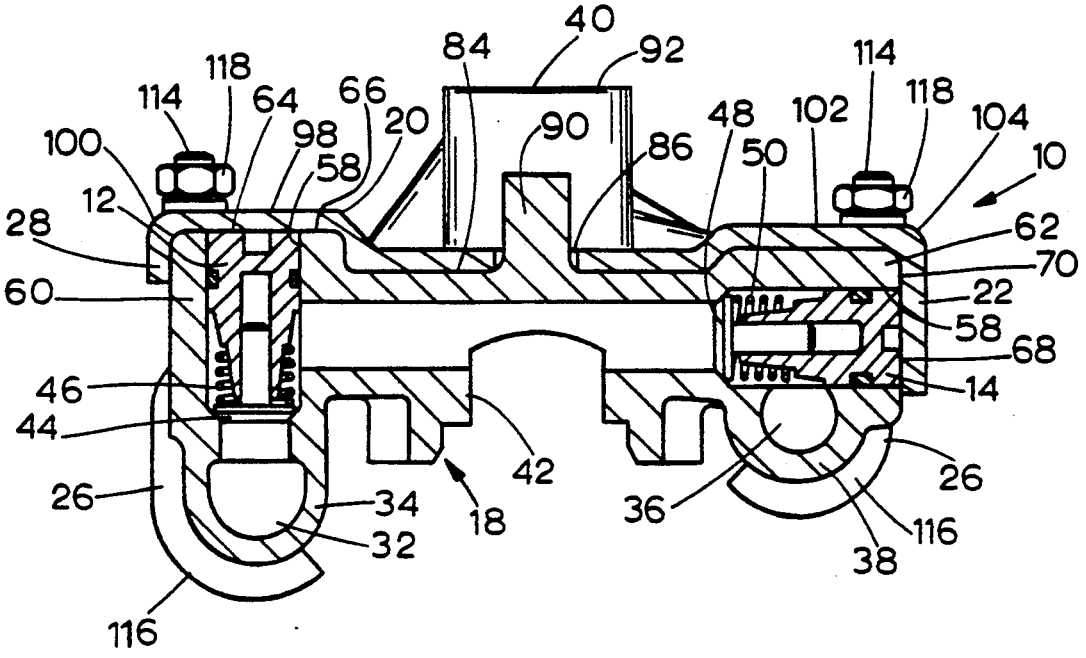
FIG. 4 comprises a cross-sectional view of the retainer plate assembly and pump housing taken along the lines 4—4 of FIG. 2.

With particular reference to FIG. 4, each of the pumping chambers 42 houses a pumping piston (not shown) which pressurizes fluid therein. Input check valves 44 mounted in the valve guides 12 are located in input conduits 46 disposed between the inlet conduit 32 and each pumping chamber 42 and are normally biased in a closed position. Each input check valve 44 is opened as the pressure in a respective pumping chamber 42 is reduced, thereby permitting fluid to enter the pumping chamber 42 from the inlet conduit 32. Output check valves 48 mounted in the valve guides 14 are disposed in output conduits 50 located between each pumping chamber 42 and the outlet conduit 36. Each output check valve 48 is also normally biased in a closed position and is opened when the pressure in the respective pumping chamber 42 increases, thereby expelling fluid from the pumping chamber 42 through the output conduit 50 and into the outlet conduit 36 of the housing 18.

With reference to FIGS. 4.6, the outlet conduit plug 16 is disposed at an end 52 of the outlet conduit 36. Fluid being expelled from each pumping chamber 42 flows toward an outflow end 54 of the outlet conduit 36. A recirculation portion 56 of the pump housing 18 communicates with the outlet 40, the inlet conduit 32 and the outlet conduit 36 and is located near the outflow end 54.

Each of the input and output valve guides 12 and 14 has an outer cylindrical surface adapted to be inserted within guide bores 58 disposed in cylindrical housing portions 60 and 62, respectively, of the pump housing 18. Each guide bore 58 communicates with either a respective input conduit 46 or a respective output conduit 50. The input and output valve guides 12 and 14 are tightly received by the walls defining the guide bores 58.

When inserted in the guide bores of each housing portion 60, an end surface 64 of each input valve guide 12 is substantially flush with an end surface 66 of the respective housing portion 60. Likewise, an end surface 68 of each output valve guide 14 is substantially flush with an end surface 70 of the respective housing portion 62 when mounted therein. The end surfaces 66 are disposed in substantially the same plane as are the surfaces 70.

Figure 5:
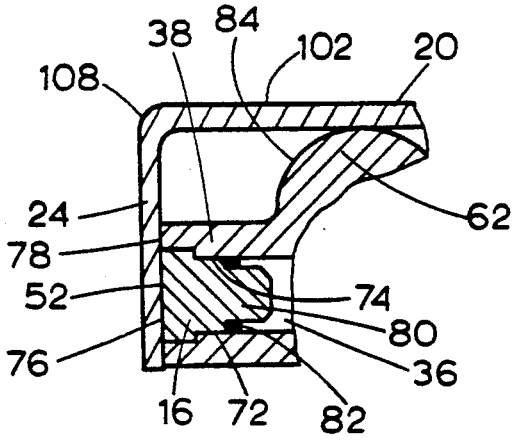
FIG. 5 comprises a fragmentary sectional view of the retainer plate assembly and pump housing taken along the lines 5—5 of FIG. 2.

With particular reference to FIG. 5, the plug 16 includes an outer substantially cylindrical surface 72 adapted to be inserted into the outlet conduit 36. The plug 16 is tightly received by inner walls 74 defining the outlet conduit 36. When inserted in the outlet conduit 36, an end surface 76 of the plug 16 is substantially flush with a surface 78 of the outlet end 52. In the illustrated embodiment, the outlet end surface 78 is disposed in a plane which is substantially perpendicular to the plane containing the end portion surfaces 70, although this not need be the case. Also in the illustrated embodiment, the plug 16 includes a projection 80 about which an annular seal 82 is disposed. The seal 82 provides a fluid tight barrier between the plug 16 and the walls 74 defining the outlet conduit 36.

With reference to all the Figures, the primary retainer plate section 20 generally follows the contours of and contacts a substantial portion of a surface 84 of the pump housing 18 wherein the surface 84 includes the end surfaces 66 of the valve guide cylindrical housing portions 60 and parts of each cylindrical housing portion 62. The plate section 20 includes apertures 86 and 88 through which a projection 90 and an outlet housing 92 of the pump housing 18 protrude when the plate assembly 10 is mounted on the pump housing 18 as shown in FIGS. 1–5. The cooperation between the apertures 86 and 88 and the projection 90 and the housing 92, respectively, aid in aligning the plate assembly 10 with respect to the pump housing 18 to result in a secure retention of the valve guides 12 and 14 and the plug 16 within the housing 18.

The plate section 20 also includes apertures 94 which are adapted to align with apertures 96 disposed in the pump housing 18 to facilitate mounting both the pump housing 18 and the plate assembly 10 to a further pump portion (not shown) of a pressure washer (not shown).

The plate section 20 further includes a generally flat portion 98 adjacent an edge 100. When the plate assembly 10 is mounted on the pump housing 18, the flat portion 98 abuts against the end surfaces 64 of the input valve guides 12 and the end surfaces 66 of the respective housing portions 60.

The plate section 20 includes another generally flat portion 102 adjacent an edge 104 opposite the edge 100. When the plate assembly 10 is mounted on the pump housing 18, the flat portion 102 contacts each housing portion 62. Each flat portion 98 and 102 includes apertures 106 located near the edges 100 and 104 and adapted for the insertion of the hook bolts 26 therethrough. While the Figures illustrate two evenly spaced apertures 106 near each edge 100 and 104, the number and spacing of the apertures 106 may vary depending upon the pump housing configuration.

The plate retainer sections 22, 24 and 28 meet the plate section 20 along the edge 104, an edge 108, and the edge 100, respectively. Each plate section 22, 24 and 28 is generally perpendicular to the plate section 20. When the plate assembly 10 is mounted on the pump housing 18, the sections 22 and 24 abut against end surfaces 68 of the output valve guides 14 and the end surface 76 of the plug 16, respectively.

The plate section 22 is generally perpendicular to the plate section 24 and has a tab 110 integral therewith. The tab 110 is bent approximately perpendicular to the section 22 and contacts an external surface 112 of the section 24. The tab 110 provides support for the plate section 24 by retaining the plate section 24 against the end surface 76 of the plug 16 and the end surface 78 of the outlet conduit housing portion 38. The tab 110 may be welded or otherwise fastened to the plate section 24.

When the plate assembly 10 is mounted on the pump housing 18, the section 28 contacts each housing portion 60. The section 28 is adapted to cooperate with the plate sections 20 and 22 to provide a friction fit between the plate assembly 10 and the pump housing 18. More particularly, the cooperation between the plate sections 20, 22 and 28 results in a snug, frictional engagement between the plate 22 and the output valve guides 14, thus securing the output check valves 48 within the housing 18.

Figure 1:
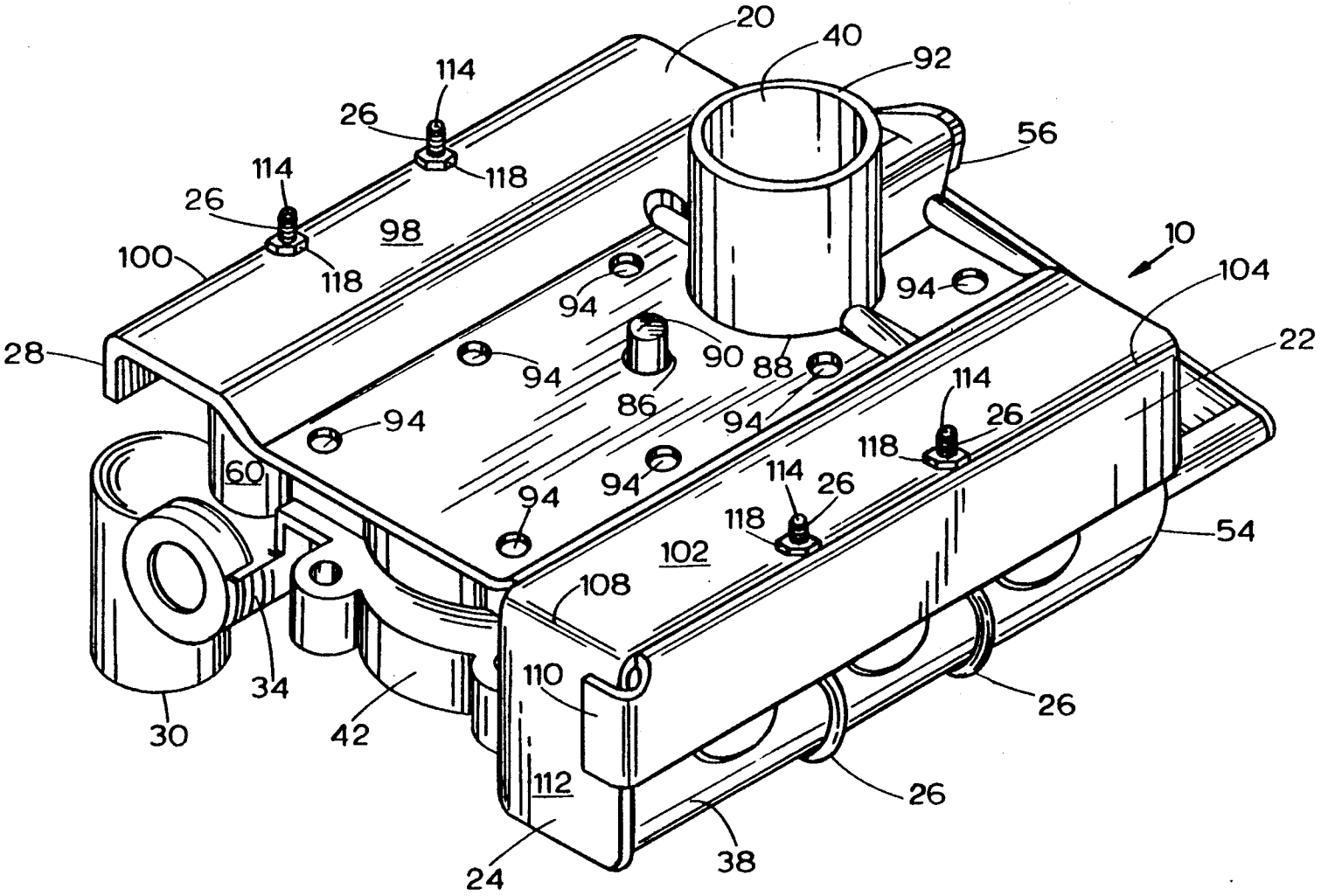
FIG. 1 comprises an isometric view of a retainer plate assembly according to the invention attached to a pump housing of a pressure washer.
Figure 2:
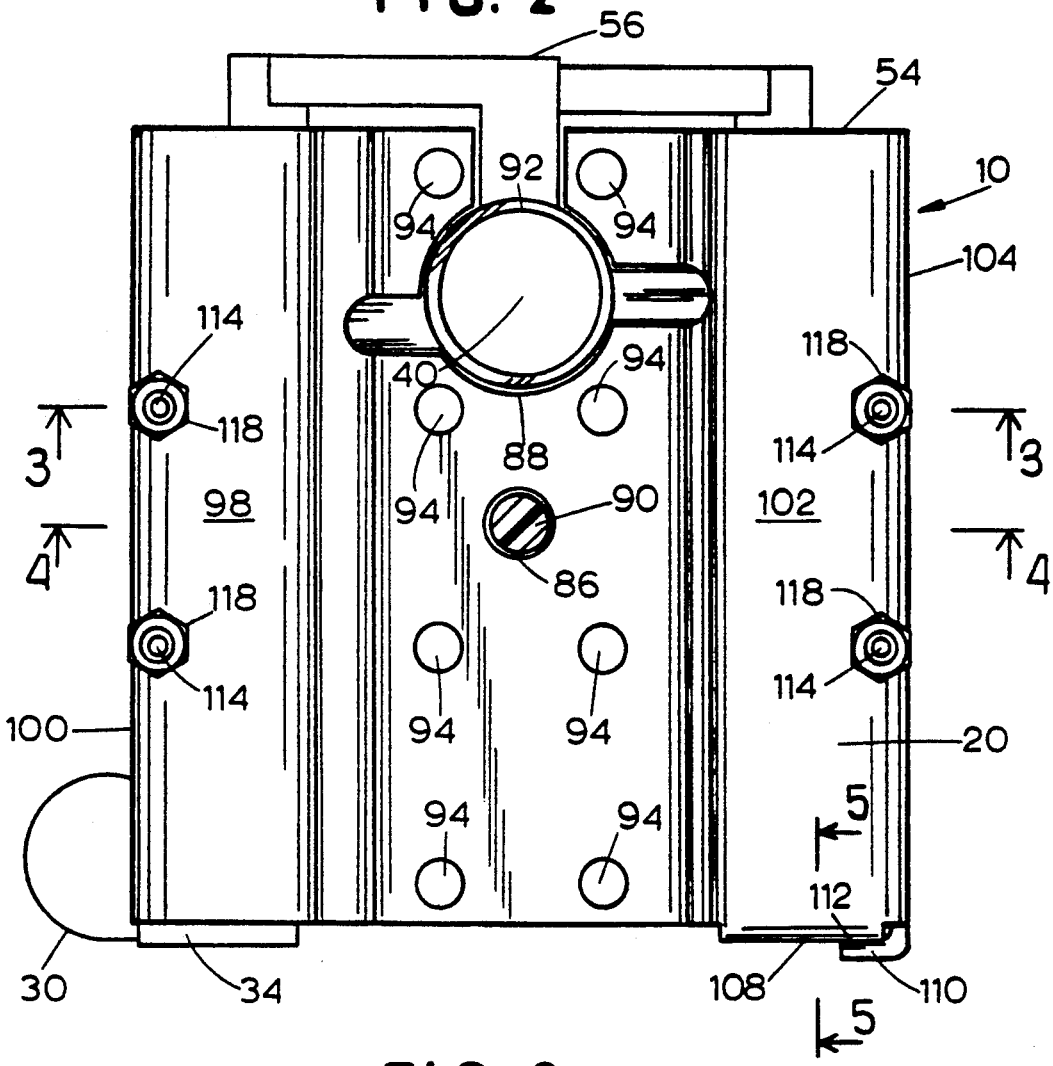
FIG. 2 comprises a plan view of the retainer plate assembly and pump housing shown in FIG. 1.
Figure 3:
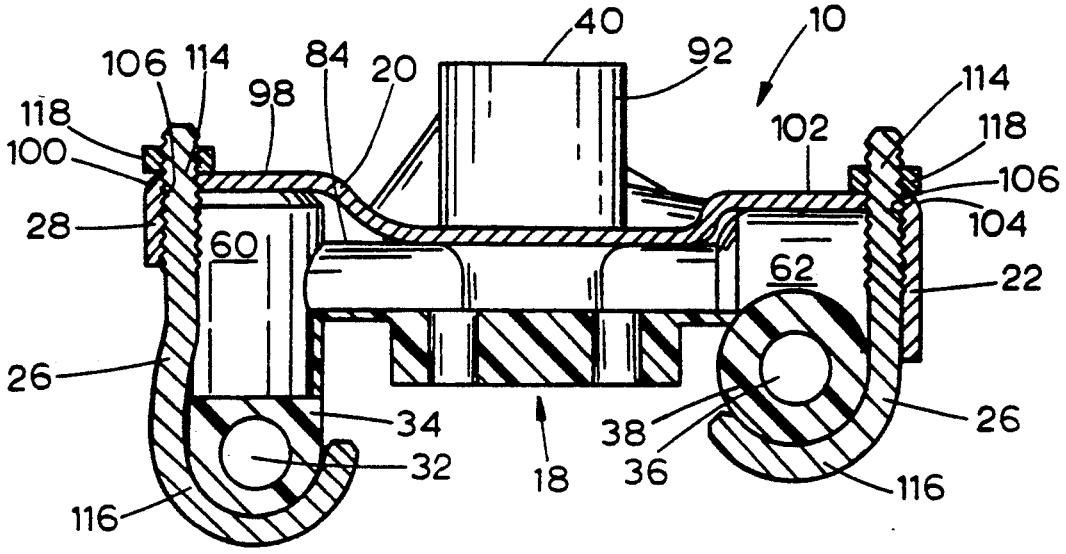
FIG. 3 comprises a cross-sectional view of the retainer plate assembly and pump housing taken along the lines 3—3 of FIG. 2.

Each hook bolt 26 includes a threaded shank 114 and a bent or hook portion 116. The threaded shank 114 of each hook bolt 26 is adapted for insertion in one of the apertures 106 of the plate section 20 and is secured to the plate section 20 by fastening means illustrated by a nut 118 which abuts the surface 84 of the plate section 20. Each hook portion 116 partially encircles one of the cylindrical housing portions 34 or 38. As shown in FIGS. 1 and 2, four hook bolts 26 are included in the plate assembly 10, two of which hook about the cylindrical housing portion 34 and the other two of which hook about the cylindrical housing portion 38. A different number of hook bolts 26 may be used, as needed or desired. As the nuts 118 are tightened on the shanks 114, the hook bolts 26 urge the plate section 20 against the pump housing 18, thereby urging the flat portion 98 of the plate section 20 against the end surfaces 64 of the input valve guides 12 and thus securing the input check valves 44 within the housing 18.

The plate assembly sections 20, 22, 24 and 28 and the tab 110 may be made from a variety of materials including metal and plastic. A preferred material is steel which is also a preferred material for the hook bolts 26.

In addition to securing the valve guides 12 and 14 and the plug 16 within the housing 18, the plate assembly 10 provides structural support for the housing 18. In particular, with respect to the embodiment of the housing 18 shown in the Figures, the plate assembly 10 covers a portion of the housing 18 at the surface 84 which encloses two of the pumping chambers 42 and provides support for the housing enclosing these two chambers 42. When the pump housing 18, which is preferably made from a plastic material, is not equipped with the plate assembly 10, the portions of the housing 18 surrounding the chambers 42 are more apt to fatigue during pressure washer operation.

A retainer plate assembly according to the present invention may be adapted to secure valves and/or plugs within pump housings having configurations other than that shown in the FIG. 6. For example, variously configured pump housing and valve configurations are disclosed in the above identified Paige, '654 and '975 patents and Berfield, U.S. patent application No. 07/666,230 (allowed Jan. 15, 1993), now U.S. Pat. No. 5,230,471, also assigned to the assignee of the instant application, the disclosures of which are hereby incorporated by reference herein. The inventive plate assembly of the present invention suitably modified to conform with abutting structures, may be used with the pump housing 12 and the input and output valves 130 and 140, respectively, shown in FIG. 6 of the Paige '654 patent or the cylinder block 12 and valves shown in FIGS. 1, 2, 6 and 8 of U.S. patent application Ser. No. 07/666,230 or the pump module shown in FIGS. 1 and 5 of the Paige '975 patent. Although a single embodiment of a retainer plate is described herein, in view of the art incorporated by reference herein, alternative embodiments of the invention will be apparent to those skilled in the art. Inasmuch as particular pressure washer elements and pump configurations are not important to an understanding of the present invention, they will not be further described herein.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. In a pump of a pressure washer including a pump housing, an input valve and an output valve both of which are disposed in the pump housing, the improvement comprising:

a plate assembly attached to the pump housing adapted to retain both the input and output valves within the pump housing and a plug disposed within an outlet conduit of the pump housing wherein the plate assembly is adapted to retain the plug within the pump housing.

2. In a pump of a pressure washer including a pump housing, an input valve and an output valve both of which are disposed in the pump housing, the improvement comprising:

a plate assembly attached to the pump housing adapted to retain both the input and output valves within the pump housing and wherein the pump housing includes first and second body portions which enclose inlet and outlet conduits, respectively, and wherein the plate assembly comprises a plate and means for attaching the plate to the pump housing, the attaching means being fixed to the plate and partially surrounding the first and second body portions.

3. The improvement according to claim 2 wherein the attaching means comprises a hook bolt having a shank attached to the plate and a hook portion partially encircling one of the first and second body portions.

4. The improvement according to claim 2 wherein the attaching means comprises a plurality of hook bolts, each having a shank attached to the plate and a hook portion partially encircling one of the first and second body portions.

5. A plate assembly for securing at least one check valve within a pump housing wherein the valve is mounted in a valve guide and wherein the pump housing includes a bore receiving the valve guide and first and second substantially cylindrical housing portions, comprising:

a contoured plate abutting against the valve guide and the pump housing;

means for attaching the plate to the pump housing, the attaching means being connected to the plate and partially encircling the first and second cylindrical portions.

6. The plate assembly according to claim 5 wherein the contoured plate has an aperture and the attaching means comprises a hook bolt having a shank and a hook portion, the shank extending through the aperture and being connected to the plate by fastening means disposed on the shank, the hook portion partially encircling the first cylindrical portion and wherein tightening of the fastening means urges the hook portion and the plate against the pump housing.

7. The plate assembly according to claim 5 further comprising first and second parallel plates integral to the contoured plate and disposed substantially perpendicular thereto and wherein the parallel plates provide a friction fit between the plate assembly and the pump housing.

8. A plate assembly for securing a plurality of input and output check valves and at least one plug within a pump housing having a first substantially cylindrical housing portion with an inlet conduit disposed therein, a second substantially cylindrical housing portion with an outlet conduit disposed therein, a plug disposed in the outlet conduit, and a plurality of pumping chambers and wherein each input valve is mounted in an input valve guide and is disposed between the inlet conduit and one of the pumping chambers and each output valve is mounted in an output valve guide and is disposed between one of the pumping chambers and the outlet conduit, the pump housing having bores receiving the input and output valve guides, the plate assembly comprising:

a first plate section abutting against each of the input valve guides;

a second plate section attached to the first plate section and abutting against each of the output valve guides;

a third plate section attached to the first plate section and abutting against the plug;

means for attaching the first, second and third plate sections to the pump housing, the attaching means being fixed to the first plate section and partially encircling the first and second cylindrical housing portions.

9. The plate assembly according to claim 8 wherein the first plate section has an aperture and the attaching means comprises a hook bolt having a shank and a hook portion, the shank extending through the aperture and being connected to the plate by fastening means disposed on the shank, the hook portion partially encircling one of the first and second cylindrical housing portions and wherein tightening of the fastening means urges the hook portion and the first plate section against the pump housing.

10. The plate assembly according to claim 8 wherein the first plate section has at least two apertures and the attaching means comprises at least first and second hook bolts, each hook bolt having a shank and a hook portion, each shank extending through one of the apertures and being connected to the plate by fastening means disposed on the shank, each hook portion partially encircling one of the first and second cylindrical housing portions and wherein tightening of each fastening means urges the hook portion and the first plate section against the pump housing.

11. The plate assembly according to claim 8 comprising a fourth plate section attached to the first plate section and being oriented generally parallel to the second plate section and wherein the fourth plate section and the second plate section retain the second plate section in frictional engagement with the output valve guides.

12. The plate assembly according to claim 11 wherein the second, third and fourth plate sections are oriented substantially perpendicular to the first plate section.

13. The plate assembly according to claim 11 wherein the second, third and fourth plate sections are integral to the first plate section.

* * * * *